US005211909A

United States Patent [19]

Iseda et al.

[11] Patent Number: 5,211,909

[45] Date of Patent: May 18, 1993

[54] LOW-ALLOY HEAT-RESISTANT STEEL HAVING IMPROVED CREEP STRENGTH AND TOUGHNESS

[75] Inventors: Atsuro Iseda, Kobe; Yoshiatsu Sawaragi, Nishinomiya; Fujimitsu Masuyama, Nagasaki; Tomomitsu Yokoyama, Chofu, all of Japan

[73] Assignees: Sumitomo Metal Industries, Ltd., Osaka; Mitsubishi Jukogyo Kabushiki Kaisha, Tokyo, both of Japan

[21] Appl. No.: 837,917

[22] Filed: Feb. 20, 1992

[30] Foreign Application Priority Data

Feb. 22, 1991 [JP] Japan ..... 3-28233

[51] Int. Cl.[5] ..... C22C 38/24; C22C 38/26

[52] U.S. Cl. ..... 420/106; 420/110

[58] Field of Search ..... 420/106, 108, 109, 110, 420/113

[56] References Cited

FOREIGN PATENT DOCUMENTS 57-131349 8/1982 Japan .
57-131350 8/1982 Japan .
62-54062 3/1987 Japan .
63-62848 3/1988 Japan .
64-68451 3/1989 Japan .
2-217438 8/1990 Japan .
2-217439 8/1990 Japan .

*Primary Examiner*—Deborah Yee
*Attorney, Agent, or Firm*—Burns, Doane, Swecker & Mathis

[57] ABSTRACT

A low-alloy steel consists essentially, on a weight basis, of: C: 0.03–0.12%, Si: at most 0.7%, Mn: 0.1–1.5%, Ni: at most 0.8%, P: at most 0.03%, S: at most 0.015%, Cr: 1.5–3.5%, W: 1–3%, V: 0.1–0.35%, Nb: 0.01–0.1%, B: 0.0001–0.02%, N: less than 0.005%, Al: less than 0.005%, Ti: 0.001–0.1%, optionally one or more elements selected from the group consisting of: La, Ce, Y, Ca, Zr, and Ta: 0.01–0.2%, Mg: 0.0005–0.05%, and Mo: 0.01–0.4%, and a balance of Fe and incidental impurities, wherein the Ti and Ni contents satisfy the following inequality:

$$0.080 > Ti(\%) - (48/14) \times N(\%) > 0.003.$$

The steel has improved creep strength at high temperatures and improved toughness. It can be substituted for expensive austenitic stainless steels or high-Cr ferritic steels.

19 Claims, 4 Drawing Sheets

LOW-ALLOY HEAT-RESISTANT STEEL HAVING IMPROVED CREEP STRENGTH AND TOUGHNESS

BACKGROUND OF THE INVENTION

The present invention relates to a Cr- and W-containing low-alloy heat-resistant steel. More particularly, it relates to such a low-alloy steel which exhibits high creep strength at high temperatures above 550 ° C. and improved low-temperature toughness at room temperature or below and which is suitable for use as forgings and castings in various forms including heat-exchanger tubes, piping, heat-resistant valves, and connecting joints in applications such as boilers, chemical plants, and nuclear facilities.

Heat- and pressure-resisting parts for boilers, chemical plants, or nuclear facilities are usually made of a steel selected from austenitic stainless steels, high-Cr ferritic steels having a Cr content of 9%–12% (all percents given herein are by weight as long as they are concerned with an alloy composition), Cr—Mo low-alloy steels having a Cr content of up to 3.5%, or carbon steels. The material to be employed is selected by considering the environment in which it is used (including the temperature and pressure) and its cost.

Among the above-mentioned steels, Cr—Mo low-alloy steels containing up to 3.5% Cr are characterized in that they have improved oxidation resistance, hot corrosion resistance, and high-temperature strength compared to carbon steels. Their advantages over austenitic stainless steels are that they are significantly less expensive, have a lower coefficient of thermal expansion, and do not cause stress-corrosion cracking. When compared to high-Cr ferritic steels, they are less expensive and have better toughness, thermal conductivity, and weldability.

Typical examples of these low-alloy steels for tubes are T22 (2.1/4Cr-1Mo steel), T12, and T2, as defined in ASTM and ASME. These are generally called Cr—Mo steels. Many attempts to improve the high-temperature strength of these alloys by adding one or more precipitation-strengthening elements such as V, Nb, Ti, Ta, and B had been made. See, for example, Japanese Patent Applications Laid-Open Nos. 57-131349(1982), 57-131350 (1982), 62-54062(1987), 63-62848(1988), and 64-68451(1989).

Among the steels well known as a material for turbines is 1Cr-1Mo-0.25V steel, while 2.1/4Cr-1Mo- Nb steel was developed as a material for fast breeder reactors.

However, compared to high-Cr ferritic steels and austenitic stainless steels, these Cr—Mo low-alloy steels are still inferior with respect to resistance to oxidation and corrosion at high temperatures, and their high-temperature strength is significantly lower. Therefore, they suffer from problems when used at a temperature above 550° C. In this respect, one of the present inventors has proposed a heat-resistant low-Cr steel which has improved resistance to oxidation and corrosion at high temperatures and improved high-temperature strength and which can be used as a substitute for high-Cr ferritic steels and austenitic stainless steels [Japanese Patent Applications Laid-Open Nos. 2-217438 (1990) and 2-217439(1990)].

The resistance to oxidation and to hot corrosion of a steel mainly depends on its Cr content. Therefore, an increased Cr content is effective in improving these properties. However, an increased Cr content also leads to a loss of the good thermal conductivity, toughness, weldability, and inexpensiveness which are characteristic of low-alloy steels. Of course, when low-alloy steels are used in an environment in which oxidation resistance and hot corrosion resistance are not critical, there is no need to increase the Cr content.

However, high-temperature strength is quite important in designing pressure-resisting parts and it is always desirable that the material have good high-temperature strength, regardless of the temperature at which it is used. Particularly, in heat- and pressure-resistant steel tubes used in boilers, chemical plants, and nuclear facilities, the wall thickness of the tubes is determined depending on the high-temperature strength of the steel.

Thus, the following advantages will be attained by improving the strength, and particularly high-temperature strength, of low-alloy steels.

(1) It becomes possible to use a low-alloy steel in those environments where corrosion is not so severe at high temperatures but where conventionally austenitic stainless steel or high-Cr ferritic steel has been used to assure high-temperature strength. The use of low-alloy steels in such environments has been limited in the past. If low-alloy steels can be employed in such environments, one can make full use of the advantageous properties of these steels, i.e., good weldability and high toughness.

(2) The wall thickness of steel parts can be decreased. As a result, the steel parts have improved thermal conductivity, leading to an improved thermal efficiency of a plant using the parts and reduced thermal fatigue, which the parts suffer when the operation of the plant is repeatedly started or stopped.

(3) The weight of steel parts can be reduced, resulting in a reduced size of a plant and reduced manufacturing costs.

Therefore, improvement in the strength of low-alloy steels provides significant practical benefits. The prior art techniques for increasing the strength of low-alloy steels have the problem that improvement in strength is accompanied by a loss of toughness.

For example, Cr—Mo steels such as T12 and T22 defined in ASTM and ASME get their high strength through a solid-solution strengthening effect of Mo and precipitation-strengthening effects of fine carbides of Cr, Fe, and Mo. However, the contribution of the effect of Mo is not significant and the above-described carbides are not effective in improving high-temperature strength, since the carbides are coarsened rapidly at high temperatures. A conceivable measure for improving the strength of these low-alloy steels is to increase the Mo content in order to increase the solid-solution strengthening effect. However, this measure is not practicable since the attainable improvement is not so large and the toughness, workability, and weldability of the steels are undesirably decreased.

The addition of precipitation-strengthening elements such as V, Nb, Ti, and B is effective in improving the strength of a low-alloy steel. On the other hand, they excessively harden the steels. Furthermore, particularly when precipitated in a matrix of ferritic phase, they cause a significant decrease in toughness. These elements also cause a significant loss of weldability. Therefore, the contents of these elements are limited in most applications.

SUMMARY OF THE INVENTION

An object of the present invention is to provide an inexpensive, low-alloy, heat-resistant steel which still retains the advantages of low-alloy steels having a Cr content of up to 3.5% and which can be used in place of austenitic stainless steels or high-Cr ferritic steels in those applications where the use of low-alloy steels has conventionally been limited.

Another object of the invention is to provide a low-alloy steel which has significantly improved creep strength at high temperatures above 550° C., e.g., in the range of 550°–625° C. at which usual boilers are operated and which still possesses other properties such as toughness, workability, and weldability at least at the same level as conventional low-alloy steels.

The present invention provides a low-alloy steel having improved creep strength and toughness, which consists essentially, on a weight basis, of:

| | |
|---|---|
| C: 0.03–0.12%, | Si: at most 0.7%, |
| Mn: 0.1–1.5%, | Ni: at most 0.8%, |
| P: at most 0.03%, | S: at most 0.015%, |
| Cr: 1.5–3.5%, | W: 1–3%, |
| V: 0.1–0.35%, | Nb: 0.01–0.1%, |
| B: 0.0001–0.02%, | N: less than 0.005%, |
| Al: less than 0.005%, | Ti: 0.001–0.1%, |

optionally one or more elements selected from the group consisting of: La, Ce, Y, Ca, Zr, and Ta: 0.01–0.2% each, and Mg: 0.0005–0.05%, and/or Mo: 0.01–0.4%, and a balance of Fe and incidental impurities, wherein the Ti and Ni contents satisfy the following inequality (1):

$$0.080 \geqq Ti(\%) - (48/14) \times N(\%) \geqq 0.003 \quad (1).$$

DETAILED DESCRIPTION OF THE INVENTION

Figure 1:
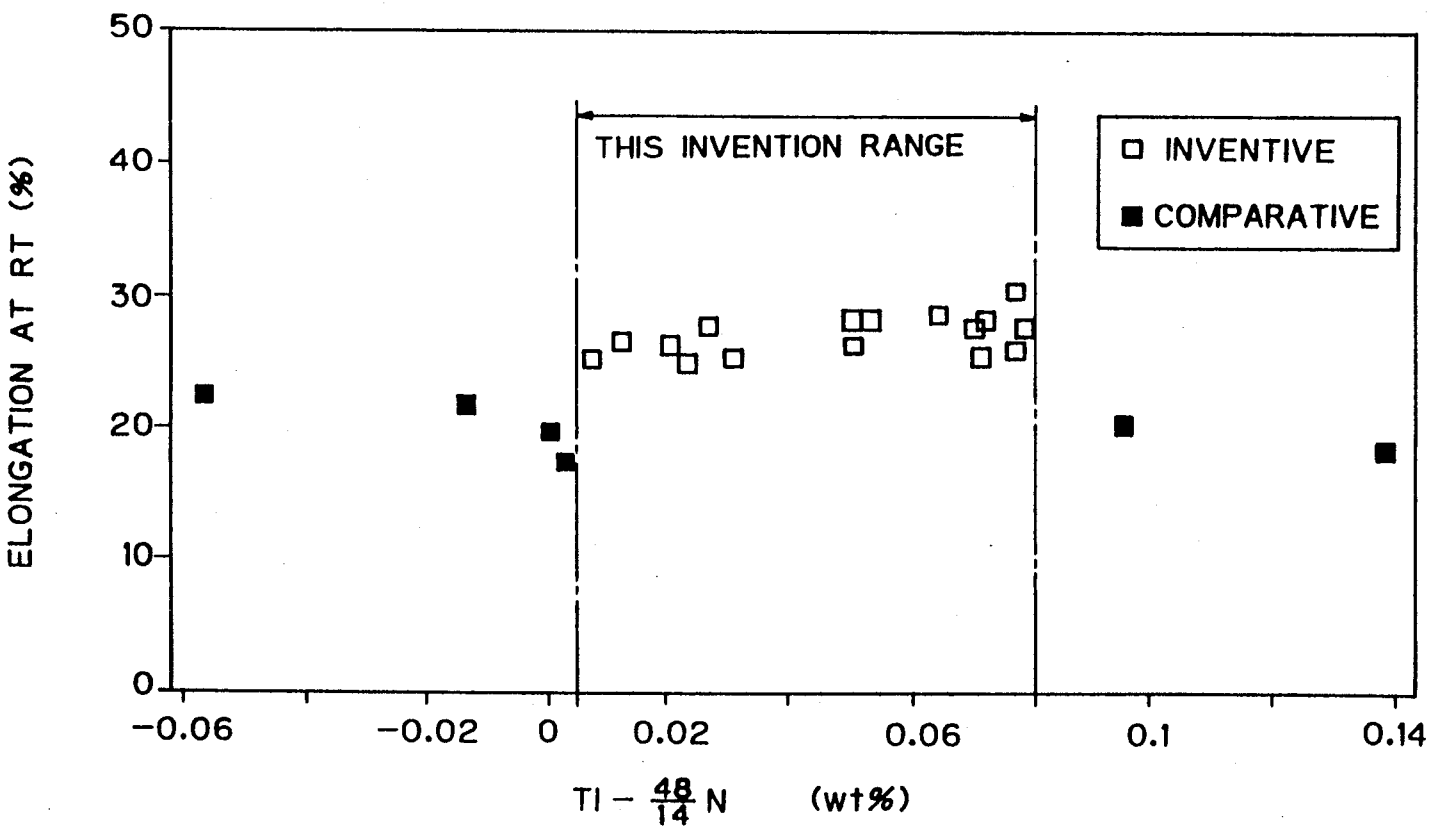
FIG. 1 is a graphical illustration showing the relationship between elongation obtained from a room temperature tensile test and the parameter: $[Ti(\%) \times (48/14) \times N(\%)]$.

The low-alloy steel according to the present invention exhibits excellent properties (described below) as an overall result of the addition of the above alloying elements in optimum proportions. Major characteristics of the steel are as follows.

(a) Since N tends to decrease long-term creep strength, the N content is limited to less than 0.005% and N is fixed as TiN by the addition of a slight amount of Ti. In addition, B is added in a slight amount. As a synergistic effect of these measures, the steel has a significantly improved creep strength. This effect is assured when the Al content is limited to less than 0.005%.

(b) By adjusting the content of N and Ti so as to satisfy the above inequality (1), the steel is also improved in toughness.

(c) V and Nb are added as precipitation-strengthening elements and W is added as an essential element based on the finding that W is more effective than Mo as a solid-solution strengthening element.

The effect of each alloying element and the reason for restricting its content as above are described below.

C (carbon):

C combines with Cr, Fe, W, V, Nb, Ti, and optionally added Mo to form carbides of these elements, thereby contributing to high-temperature strength. Furthermore, C. itself is an austenite-stabilizing element and plays an important role in the formation of martensite, bainite, or pearlite structure. A C content of less than 0.03% not only cannot precipitate carbides in an amount sufficient to attain a satisfactory level of strength, but also forms an increased amount of δ-ferrite, leading to a loss of toughness. When the C. content is higher than 0.12%, carbides are precipitated excessively and hence the steel is hardened to such a degree that workability and weldability are undesirably deteriorated. Therefore, C is present in an amount of 0.03–0.12%. A preferred C content in this range is 0.05–0.08%.

Cr (chromium):

Cr is an essential element to improve the oxidation resistance and hot corrosion of a low-alloy steel. The low-alloy steel of the invention is a heat-resistant steel exhibiting an increased creep strength at high temperatures in the range of 550–625° C. However, if the Cr content is less than 1.5%, the steel is not practicable due to a significant loss of resistance to oxidation and hot corrosion. The maximum Cr content is limited to 3.5% so as to retain the above-described advantageous properties characteristic of low-alloy steels. A Cr content exceeding 3.5% results in deteriorated toughness, weldability, and thermal conductivity and adds to the material costs.

Si (silicon):

Si is added as a deoxidizer and serves to improve resistance to steam oxidation. However, the addition of Si in excess of 0.7% leads to a loss of toughness and workability and, particularly in thick-walled parts, promotes temper embrittlement. Therefore, the Si content is limited to at most 0.7%. Preferably the Si content is 0.01–0.4%.

Mn (manganese):

Mn serves to improve the hot-workability of the steel and also contributes to a stabilization of the high-temperature strength of the steel. At an Mn content of less than 0.1%, these effects cannot be expected. An Mn content exceeding 1.5% causes the steel to harden extremely, leading to a loss of workability and weldability. Like Si, Mn is an element which increases susceptibility to temper embrittlement. Therefore, the Mn content is limited to at most 1.5%. Preferably the Mn content is 0.3–1%.

Ni (nickel):

Ni is an austenite-stabilizing element and also serves to improve toughness. The addition of Ni in excess of 0.8% results in a loss of high-temperature creep strength. A higher Ni content is also undesirable from the standpoint of economy. Therefore, the Ni content is limited to at most 0.8%. Preferably the Ni content is 0.01–0.4%.

W (tungsten):

W serves to strengthen a steel not only by the solid-solution hardening effect but also by the precipitation-strengthening effect resulting from the formation of finely dispersed carbides. As a result, W is highly effective in improving the creep strength of the steel significantly. In Cr—Mo steels which are prevalent among conventional low-alloy steels, Mo is added for the same purpose. Compared to Mo, W has a decreased coefficient of diffusion due to having a larger atomic size than Mo. As a result, it is more effective than Mo for improving creep strength at high temperatures above 550° C. over the long term. For this reason, in accordance with the present invention, W is added as an essential element in an amount of 1–3%. The addition of less than 1% W cannot attain the desired effect, while the addition of more than 3% W causes the steel to harden extremely, leading to a loss of toughness, workability, and weldability. Preferably the W content is 1.4–1.8%.

V (vanadium):

V primarily combines with C to form fine carbide of VC, thereby contributing to improve creep strength. This effect is not attained when the V content is less than 0.1%. However, the addition of more than 0.35% V causes an undesirable deterioration in creep strength and results in a loss of toughness and weldability. Therefore, V is added in an amount of 0.1–0.35% and preferably 0.2–0.3%.

Nb (niobium):

Like V, Nb also primarily combines with C to form NbC, thereby contributing to improve creep strength. Particularly at temperatures below 625° C., NbC is present as stable fine precipitates so that the creep strength is significantly improved. This effect is not attained sufficiently when the Nb content is less than 0.01%. The addition of more than 0.1% Nb hardens the steel excessively, leading to a loss of workability and weldability. Therefore, Nb is added in an amount of 0.01–0.1% and preferably 0.03–0.08%.

Al (soluble aluminum):

Al is added as a deoxidizer. Conventional low-alloy steels contain more than 0.005% sol. Al in order to deoxidize the steels sufficiently. However, it has been found in the steel according to the invention that the addition of an excess amount of Al deteriorates creep strength and toughness of the steel. It is believed that such deterioration is caused by a chemical attraction of Al with N, which acts on the quantitative balance of N to vary relative to B and Ti so that the fine precipitates formed in the steel are undesirably modified. Therefore, the Al content is limited to less than 0.005%. In spite of such a low Al content, the steel is sufficiently deoxidized due to the presence of other deoxidizing elements, e.g., C, Si, Mn, and optionally added La, Ce, Y, and Mg which are mentioned below.

B (boron):

The addition of very slight amount of B is effective for dispersing and stabilizing carbides, thereby improving high-temperature, long-term creep strength. This effect of B is significant particularly when the N content is controlled to a low level. When the steel has a high N content, B undesirably combines with N, thereby forming coarse precipitates and losing its ability to improve strength. It is an important feature of the present invention to make full use of the effect of B by controlling the Al content and keeping a balance between the N and Ti contents as described below. The effect of B is not significant when the B content is less than 0.0001%. The addition of more than 0.02% B results in a significant deterioration in workability and weldability and the above described advantageous effects of B saturate at such a high B content. Therefore, B is added in an amount of 0.0001–0.02% and preferably 0.001–0.005%.

Ti (titanium):

Ti combines with C. and N to form Ti(C,N). Since the bonding force of Ti with N is particularly strong, a slight amount of Ti is added for stabilization of N as TiN in the steel of the present invention. Such stabilization of N with Ti is markedly effective for improving the creep strength of a B-containing steel and improving toughness due to a decrease in the amount of N which is present as a solid solution. This effect of Ti cannot be attained when the Ti content is less than 0.001%. The addition of more than 0.1% Ti results in the formation of coarse Ti(C,N) precipitates, leading to a significant loss of strength and toughness. Therefore, Ti is added in an amount of 0.001–0.1%.

N (nitrogen):

As described above, when present in the form of a solid solution, N significantly deteriorates the toughness and creep strength of a steel. Furthermore, N combines with V, Nb, and Ti to form coarse precipitates, leading to a loss of toughness. It has also been found that N has the adverse effect of making bainite, martensite, and pearlite structures unstable at high temperatures. Therefore, the N content is limited to less than 0.005%.

Furthermore, it is necessary for the N and Ti content to satisfy the following inequality (1):

$$0.080 \geqq Ti(\%) - (48/14) \times N(\%) \geqq 0.003 \quad (1)$$

Inequality (1) determines the proper range of Ti content as a function of the N content. It is necessary to maintain a balance between the N and Ti contents since the presence of excess Ti leads to a loss of toughness and strength while a shortage of Ti results in an increased amount of N which is present as a solid solution, also leading to a loss of strength and toughness. The above inequality is an empirical one derived from the results of a number of experiments performed by the present inventors.

In one embodiment of the present invention, the low-alloy steel consists essentially of the above-described alloying elements and a balance of Fe and incidental impurities. Among the impurities, P (phosphorus) and S (sulfur) have adverse effects, particularly on toughness and creep ductility of the steel, and it is preferred that the contents of P and S be as low as possible. An acceptable upper limit on the P content is 0.03% and on the S content is 0.015%. Preferably, the contents of P and S are controlled to be at most 0.02% and 0.005%, respectively.

The low-alloy steel of the present invention may contain, in addition to the above alloying elements, one or more of the following optional alloying elements.

La (lanthanum), Ce (cerium), Y (yttrium), Ca (calcium),

Zr (zirconium), Ta (tantalum), and Mg (magnesium):

These elements combine with the impurities P, S, and O (oxygen), thereby favorably changing the shapes of the resulting precipitates (inclusions). Therefore, one or more of these elements may be added for the purpose of so-called inclusion shape control.

When at least one of La, Ce, Y, Ca, Zr, and Ta is added each in an amount of 0.01% or more, the resulting steel has improved toughness, strength, workability, and weldability due to the above-mentioned effect. The addition of these elements each in an amount of less than 0.01% is not effective, while the addition thereof each in an amount of more than 0.2% results in the formation of such a large amount of inclusions that the toughness and strength are deteriorated. Preferably, these elements have a content of 0.02–0.15%, when added.

Mg also serves to improve toughness and workability of the steel when added in a slight amount, since it combines with O and S. Mg is also effective in improving creep ductility and strength. However, an Mg content of less than 0.0005% is not sufficient to attain the above effects. At a content of more than 0.05% Mg, its effects saturate and the steel has decreased workability. Therefore, when added, Mg should have a content in the range of 0.0005–0.05% and preferably 0.0005–0.01%.

When two or more of these optional alloying elements (La, Ce, Y, Ca, Zr, Ta, and Mg) are added, it is preferred that their total content be not greater than 0.2% and more preferably not greater than 0.15%.

Mo (molybdenum):

Like W, Mo has both effects of solid-solution strengthening and precipitation-strengthening. However, in the low-alloy steel of the present invention which contains W in a relatively large amount, it is not always necessary to add Mo for the purpose of strengthening the steel. Nonetheless, the addition of a small amount of Mo along with W is effective in improving strength and toughness. This effect is not significant when the Mo content is less than 0.01%. At an Mo content of more than 0.4%, the strengthening effect is saturated and the steel is deteriorated in toughness and workability. Therefore, when added, Mo should have a content of 0.01–0.4% and preferably 0.05–0.2%.

The following example is presented as a specific illustration of the present invention. It should be understood, however, that the invention is not limited to the specific details set forth in the example.

EXAMPLE

The low-alloy steels having the compositions shown in Table 1 were melted in a 150 kg vacuum melting furnace and cast into ingots. Each ingot was forged in a temperature range of 1150°–950° C. to form a 20 mm-thick plate.

Among the steels prepared, Steels A and B corresponded to T12 and T22, respectively, both of which are conventional low-alloy steels employed in the prior art. Steels C. and D were comparative steels of the precipitation-strengthening type which had a basic composition of 2.1/4Cr-1Mo and contained V and Nb as additional alloying elements. Steels D through I were similar comparative steels in which the contents of B, N, and Ti were varied. Steel J was the other comparative steel in which W was added in place of Mo. Steels K through Z were steels according to the present invention (hereinafter referred to as inventive steels).

Steels A and B were subjected to heat treatment according to the specifications defined in ASTM and ASME, which consisted of heating at 920° C. for 1 hour followed by air cooling and subsequent heating at 720° C. for 1 hour followed by air cooling.

The remaining Steels C. through Z were subjected to normalizing-tempering heat treatment, which consisted of heating at 1050° C. for 0.5 hours followed by air cooling and subsequent heating at 750° C. for 3 hours followed by air cooling.

Each of the heat-treated steels was evaluated by a tensile test at room temperature, a creep rupture test, a Charpy impact test, and a weldability test.

The room temperature tensile test was performed using tensile test pieces having a gauge length of 30 mm and a diameter of 6 mm.

Test pieces of the same dimensions as above were used in the creep rupture test, which was performed at 600° C. for up to 15,000 hours. The results were expressed as values for creep rupture strength at 600° C. after $10^4$ hours (600° C.$\times 10^4$h), which was determined by interpolation.

The Charpy impact test was performed to determine the ductile-brittle transition temperature using 2 mm V-notched test pieces (JIS No. 4 test pieces) having dimensions of $10\times 10\times 55$ (mm).

The weldability test was performed by a y-groove restricted weld cracking test (JIS Z3158) to determine the lowest preheating temperature required to prevent the test steel from cracking.

The test results are shown in Table 2 and FIGS. 1 to 4.

FIG. 1 is a graph showing the relationship between elongation at rupture in the room temperature tensile test and the parameter $[Ti(\%)-(48/14)\times N(\%)]$. All the inventive steels had an elongation of 25% or higher, and it is apparent that they were improved in ductility.

Figure 2:
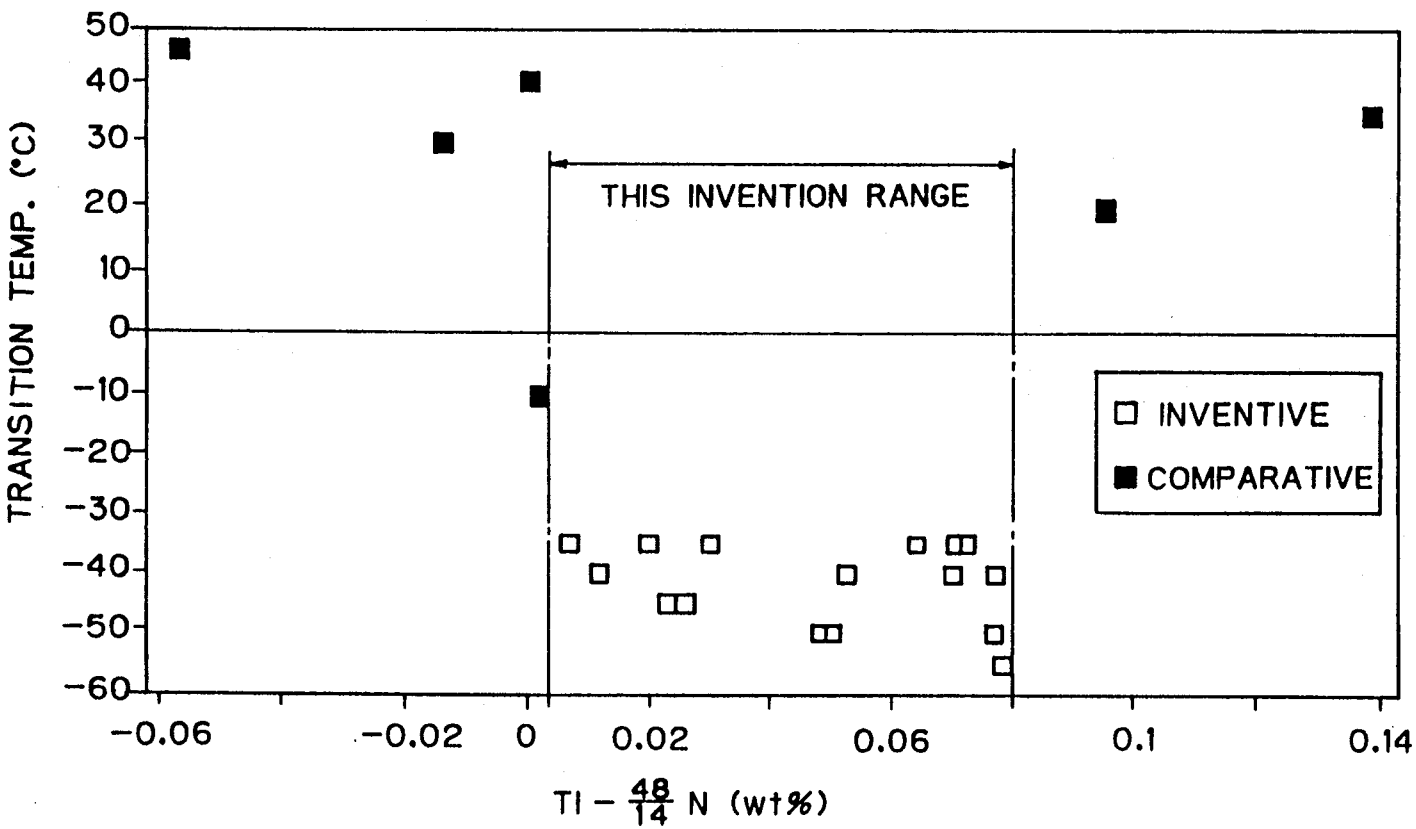
FIG. 2 is a graphical illustration showing the relationship between ductile-brittle transition temperature in a Charpy impact test and the above parameter.

FIG. 2 is a graph showing the relationship between ductile-brittle transition temperature in the Charpy impact test and the above parameter. The transition temperatures of each inventive steel was below −30° C. Namely, its low-temperature toughness was comparable to or higher than that of conventional Steels A and B and much higher than that of the comparative steels. Thus, the effect of the N and Ti contents, which were adjusted so as to satisfy the relationship defined by the foregoing inequality (1), was demonstrated.

Although conventional Steels A and B had good toughness, their creep rupture strength was significantly low as discussed below. This is because they were free from W and the precipitation-strengthening elements, V, Nb, and B.

Figure 3:
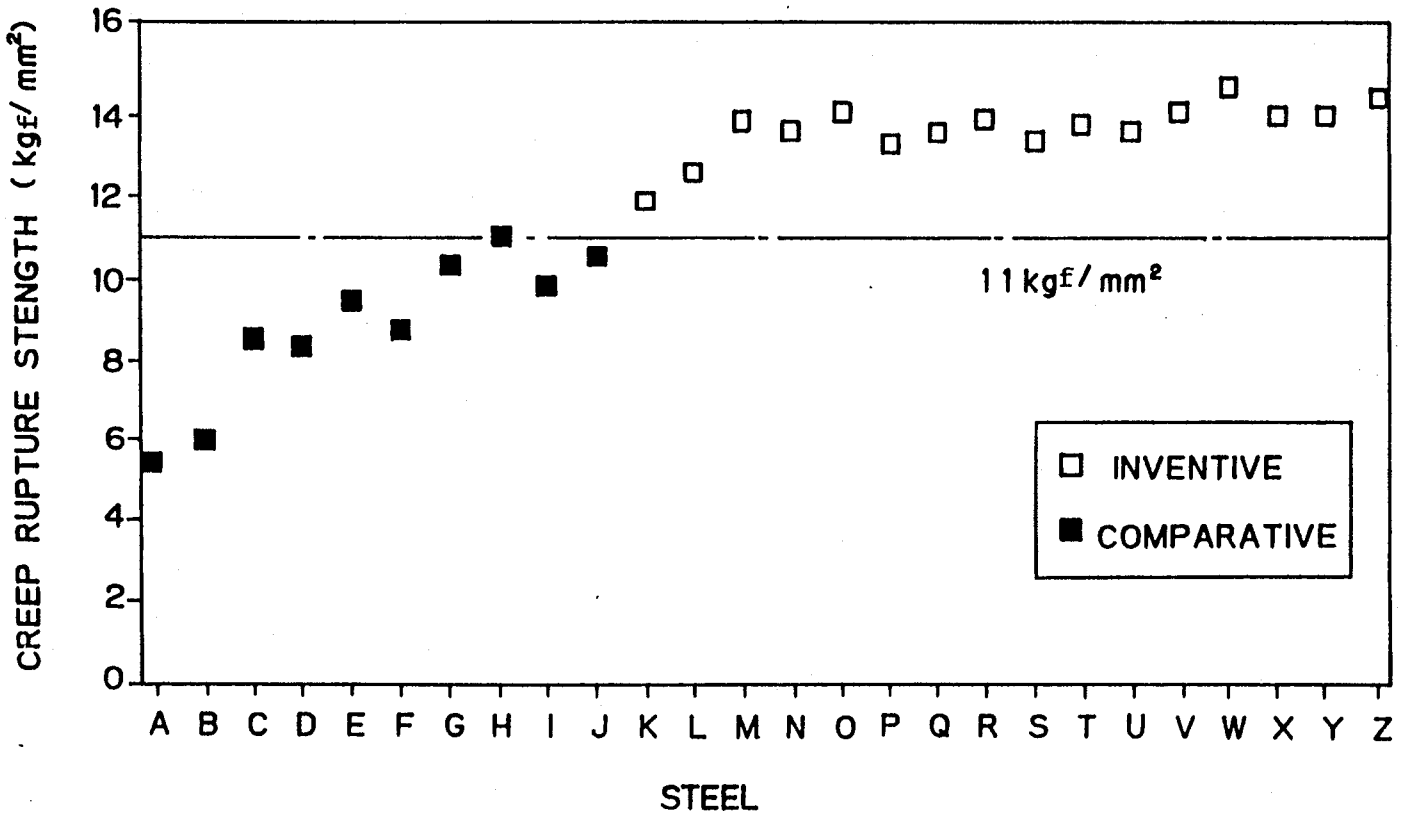
FIG. 3 shows the 600° C. $\times 10^4$h creep rupture strength of each steel tested.

FIG. 3 shows the 600° C. $\times 10^4$h creep rupture strength of each steel tested. Each of the inventive steels had a high strength value of 11 kgf/mm$^2$ or more, which was higher than that of each comparative steel.

Figure 4:
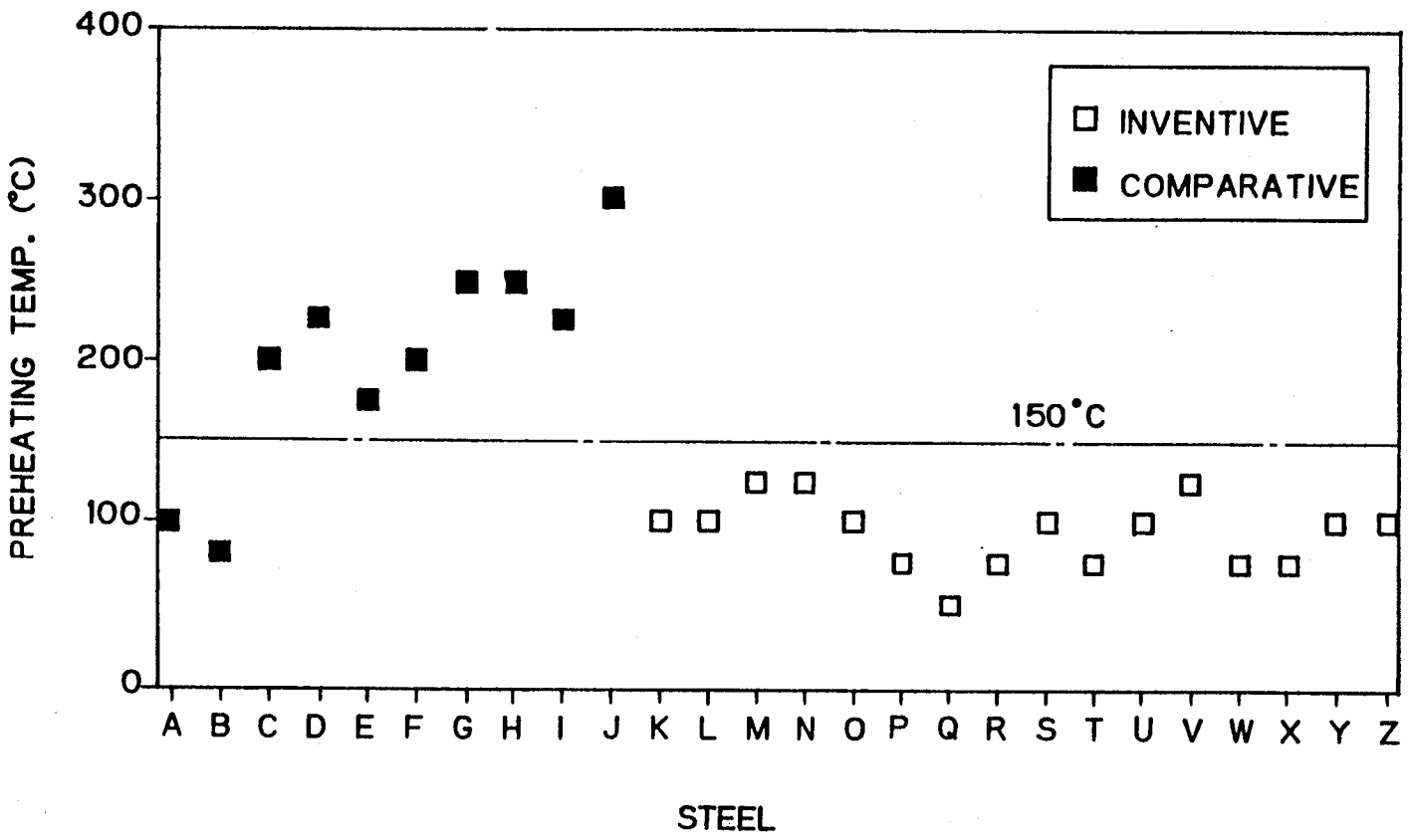
FIG. 4 shows the lowest preheating temperature required to prevent each steel tested from weld cracking in an y-groove restricted weld cracking test.

FIG. 4 shows the results of a test for evaluating the susceptibility to weld cracking of each test steel. As can be seen from the results for Steels C. to J, the addition of V, Nb, or B tends to increase the susceptibility to weld cracking. As a result, in order to prevent the steels from weld cracking, they must be preheated at a relatively high temperature in the range of 175°–300° C. Thus, it is apparent that the addition of only V, Nb, and B to a conventional steel with the intention of improving creep strength is accompanied by the disadvantage of decreased weldability. In contrast, each of the inventive steels had improved weldability and could be prevented from weld cracking by preheating at a relatively low temperature in the range of 75°–125° C.

As discussed above, compared to conventional low-alloy steels, the low-alloy steel according to the present invention has significantly improved creep strength at high temperatures, e.g., in the range of 550°–625° C. Nevertheless, its toughness, weldability, and ductility remain at satisfactory levels which are comparable to or higher than those of conventional steels. Therefore, it can be used in those applications where high-Cr ferritic steels or austenitic stainless steels have conventionally been used and it serves well as a much less expensive substitute for these steels.

Although the present invention has been described with respect to preferred embodiments, it is to be understood that variations and modifications may be employed without departing from the concept of the invention as defined in the following claims.

TABLE 1

(% by weight, Fe: balance)

| Steel No. | C | Si | Mn | P | S | Ni | Cr | Mo | W | V | Nb | Al | B | Ti | N | Ti-48/14N | Others |
|---|---|---|---|---|---|---|---|---|---|---|---|---|---|---|---|---|---|
| COMPARATIVE STEEL | | | | | | | | | | | | | | | | | |
| A | 0.12 | 0.35 | 0.45 | 0.012 | 0.003 | 0.01 | *0.98 | *0.55 | *— | *— | *— | *0.009 | *— | *— | *0.0125 | — | |
| B | 0.11 | 0.35 | 0.55 | 0.013 | 0.005 | 0.02 | 2.14 | *1.02 | *— | *— | *— | *0.006 | *— | *— | *0.0142 | — | |
| C | *0.13 | 0.20 | 0.47 | 0.011 | 0.005 | 0.12 | 2.14 | *0.99 | *— | 0.25 | 0.07 | *0.012 | *— | *— | *0.0084 | — | |
| D | 0.12 | 0.32 | 0.53 | 0.025 | 0.004 | 0.11 | 2.21 | *0.98 | *— | 0.24 | 0.05 | 0.005 | *— | *— | *0.0092 | — | |
| E | 0.09 | 0.15 | 0.55 | 0.014 | 0.003 | 0.05 | 2.15 | *0.95 | *— | 0.23 | 0.06 | *0.009 | 0.0031 | 0.050 | *0.0158 | *—0.014 | |
| F | 0.08 | 0.25 | 0.65 | 0.023 | 0.005 | 0.11 | 2.21 | *1.05 | *— | 0.26 | 0.07 | 0.002 | 0.0025 | 0.015 | *0.0210 | *—0.057 | |
| G | *0.13 | 0.32 | 0.57 | 0.021 | 0.002 | 0.15 | 2.22 | *1.10 | *— | 0.23 | 0.05 | *0.025 | 0.0032 | 0.020 | *0.0052 | *0.002 | |
| H | 0.12 | 0.27 | 0.55 | 0.022 | 0.003 | 0.12 | 2.21 | *0.99 | *— | 0.25 | 0.06 | *0.015 | 0.0015 | *0.150 | 0.0034 | *0.138 | |
| I | 0.10 | 0.31 | 0.45 | 0.017 | 0.004 | 0.15 | 2.14 | *0.95 | *— | 0.21 | 0.07 | *0.015 | *— | *0.110 | 0.0045 | *0.095 | |
| J | 0.11 | 0.25 | 0.37 | 0.015 | 0.002 | 0.04 | 2.05 | 0.11 | 2.12 | 0.25 | 0.05 | *0.012 | *— | *— | *0.0175 | — | |
| INVENTIVE STEEL | | | | | | | | | | | | | | | | | |
| K | 0.06 | 0.55 | 0.21 | 0.003 | 0.001 | 0.25 | 2.25 | — | 1.05 | 0.25 | 0.06 | 0.003 | 0.0025 | 0.045 | 0.0045 | 0.030 | |
| L | 0.08 | 0.32 | 0.35 | 0.007 | 0.002 | 0.23 | 2.21 | — | 1.63 | 0.21 | 0.04 | 0.004 | 0.0032 | 0.064 | 0.0032 | 0.053 | |
| M | 0.07 | 0.24 | 0.85 | 0.005 | 0.001 | 0.21 | 2.10 | — | 1.89 | 0.20 | 0.02 | 0.004 | 0.0025 | 0.089 | 0.0035 | 0.077 | Mg 0.002 |
| N | 0.10 | 0.05 | 1.45 | 0.015 | 0.001 | 0.10 | 2.01 | — | 2.35 | 0.18 | 0.03 | 0.004 | 0.0032 | 0.023 | 0.0047 | 0.0069 | Ta 0.05 |
| O | 0.11 | 0.01 | 0.35 | 0.013 | 0.002 | 0.01 | 2.03 | — | 2.95 | 0.35 | 0.05 | 0.002 | 0.0024 | 0.075 | 0.0015 | 0.070 | La 0.10 |
| P | 0.04 | 0.07 | 0.56 | 0.014 | 0.001 | 0.03 | 1.56 | — | 2.01 | 0.11 | 0.07 | 0.001 | 0.0018 | 0.020 | 0.0036 | 0.077 | Ce 0.15, Zr 0.03 |
| Q | 0.07 | 0.15 | 0.65 | 0.007 | 0.003 | 0.15 | 1.87 | — | 1.89 | 0.24 | 0.08 | 0.003 | 0.0008 | 0.075 | 0.0012 | 0.071 | Ca 0.05, Y 0.03 Mg 0.003 |
| R | 0.08 | 0.25 | 0.45 | 0.009 | 0.002 | 0.54 | 1.96 | — | 1.75 | 0.26 | 0.09 | 0.003 | 0.0035 | 0.035 | 0.0045 | 0.020 | |
| S | 0.06 | 0.26 | 0.57 | 0.007 | 0.001 | 0.75 | 2.31 | — | 1.63 | 0.23 | 0.08 | 0.004 | 0.0010 | 0.023 | 0.0032 | 0.012 | |
| T | 0.07 | 0.32 | 0.46 | 0.006 | 0.003 | 0.02 | 2.75 | 0.02 | 1.59 | 0.22 | 0.07 | 0.004 | 0.0012 | 0.036 | 0.0030 | 0.026 | Mg 0.005 |
| U | 0.08 | 0.45 | 0.36 | 0.003 | 0.005 | 0.06 | 3.45 | 0.05 | 1.63 | 0.20 | 0.05 | 0.003 | 0.0023 | 0.087 | 0.0045 | 0.072 | |
| V | 0.10 | 0.24 | 0.54 | 0.002 | 0.004 | 0.12 | 3.24 | 0.23 | 1.53 | 0.19 | 0.08 | 0.004 | 0.0035 | 0.015 | 0.0037 | 0.023 | Ta 0.07 |
| W | 0.08 | 0.05 | 0.55 | 0.015 | 0.004 | 0.02 | 2.25 | 0.15 | 1.65 | 0.23 | 0.07 | 0.003 | 0.0025 | 0.092 | 0.0040 | 0.078 | La 0.02, Ce 0.04 Mg 0.002 |
| X | 0.07 | 0.07 | 0.50 | 0.014 | 0.002 | 0.21 | 2.21 | 0.35 | 1.32 | 0.25 | 0.05 | 0.004 | 0.0045 | 0.058 | 0.0025 | 0.049 | Zr 0.02 |
| Y | 0.06 | 0.03 | 0.62 | 0.025 | 0.001 | 0.32 | 2.26 | 0.26 | 2.45 | 0.25 | 0.03 | 0.002 | 0.0035 | 0.065 | 0.0045 | 0.050 | Ca 0.02, Y 0.05 |
| Z | 0.07 | 0.12 | 0.35 | 0.023 | 0.002 | 0.24 | 2.13 | 0.17 | 1.73 | 0.19 | 0.04 | 0.004 | 0.0030 | 0.075 | 0.0032 | 0.064 | |

(Note) *outside the range defined herein.

TABLE 2

| Steel No. | Room Temperature Tensile Test: Tensile Strength (kgf/mm²) | 0.2% Proof Strength (kgf/mm²) | Elongation (%) | Transition Temp. in Charpy Impact Test | 600° C. × 10⁴ h Creep Rupture Strength (kgf/mm²) | Preheating Temp. for Prevention of Weld Cracking* |
|---|---|---|---|---|---|---|
| COMPARATIVE STEEL | | | | | | |
| A | 49.5 | 34.5 | 34.3 | −30° C. | 5.5 | 100° C. |
| B | 57.5 | 37.2 | 31.5 | −35° C. | 6.0 | 80° C. |
| C | 75.8 | 62.8 | 19.3 | 0° C. | 8.5 | 200° C. |
| D | 74.3 | 61.8 | 18.5 | +20° C. | 8.3 | 225° C. |
| E | 72.6 | 58.6 | 21.6 | +30° C. | 9.5 | 175° C. |
| F | 68.1 | 57.3 | 22.3 | +45° C. | 8.8 | 200° C. |
| G | 74.6 | 61.3 | 17.6 | −10° C. | 10.3 | 250° C. |
| H | 73.5 | 60.2 | 18.6 | +35° C. | 11.0 | 250° C. |
| I | 71.5 | 58.9 | 20.3 | +20° C. | 9.8 | 225° C. |
| J | 73.5 | 63.2 | 19.5 | +40° C. | 10.5 | 300° C. |
| INVENTIVE STEEL | | | | | | |

TABLE 2-continued

| Steel No. | Room Temperature Tensile Test: Tensile Strength (kgf/mm²) | 0.2% Proof Strength (kgf/mm²) | Elongation (%) | Transition Temp. in Charpy Impact Test | 600° C. × 10⁴ h Creep Rupture Strength (kgf/mm²) | Preheating Temp. for Prevention of Weld Cracking* |
|---|---|---|---|---|---|---|
| K | 65.3 | 54.0 | 25.3 | −35° C. | 11.8 | 100° C. |
| L | 67.9 | 55.3 | 28.3 | −40° C. | 12.5 | 100° C. |
| M | 67.5 | 57.3 | 26.0 | −50° C. | 13.7 | 125° C. |
| N | 69.7 | 58.6 | 25.1 | −35° C. | 13.5 | 125° C. |
| O | 71.2 | 59.1 | 27.6 | −40° C. | 14.0 | 100° C. |
| P | 63.5 | 52.7 | 30.5 | −40° C. | 13.2 | 75° C. |
| Q | 67.3 | 56.0 | 25.4 | −35° C. | 13.5 | 50° C. |
| R | 68.3 | 57.5 | 26.3 | −35° C. | 13.8 | 75° C. |
| S | 65.7 | 54.0 | 26.5 | −40° C. | 13.3 | 100° C. |
| T | 66.8 | 57.3 | 27.6 | −45° C. | 13.7 | 75° C. |
| U | 69.1 | 56.8 | 28.3 | −35° C. | 13.5 | 100° C. |
| V | 70.3 | 59.1 | 25.0 | −45° C. | 14.0 | 125° C. |
| W | 68.3 | 57.6 | 27.6 | −55° C. | 14.5 | 75° C. |
| X | 67.2 | 55.4 | 28.3 | −50° C. | 13.8 | 75° C. |
| Y | 65.0 | 54.7 | 26.3 | −50° C. | 13.9 | 100° C. |
| Z | 66.1 | 56.0 | 28.6 | −35° C. | 14.2 | 100° C. |

(Note) *Lowest preheating temperature required to prevent the test steel from weld cracking in y-groove restricted weld cracking test (JIS Z3158).

What is claimed is:

1. A low-alloy steel having improved creep strength and toughness, which consists essentially, on a weight basis, of:

| | |
|---|---|
| C: 0.03–0.12%, | Si: at most 0.7%, |
| Mn: 0.1–1.5%, | Ni: at most 0.8%, |
| P: at most 0.03%, | S: at most 0.015%, |
| Cr: 1.5–3.5%, | W: 1–3%, |
| V: 0.1–0.35%, | Nb: 0.01–0.1%, |
| B: 0.0001–0.02%, | N: less than 0.005%, |
| Al: less than 0.005%, | Ti: 0.001–0.1%, |

one or more elements selected from the group consisting of: La, Ce, Y, Ca, Zr, and Ta: 0–0.2% each and Mg: 0–0.05%, Mo: 0–0.4%, and a balance of Fe and incidental impurities, wherein the Ti and N contents satisfy the following inequality:

$$0.080 \geqq Ti(\%) - (48/14) \times N(\%) \geqq 0.003.$$

2. The low-alloy steel of claim 1, wherein the C content is 0.05–0.08%.

3. The low-alloy steel of claim 1, wherein the W content is 1.4–1.8%.

4. The low-alloy steel of claim 1, which consists essentially of:

| | |
|---|---|
| C: 0.03–0.12%, | Si: at most 0.7%, |
| Mn: 0.1–1.5%, | Ni: at most 0.8%, |
| P: at most 0.03%, | S: at most 0.015%, |
| Cr: 1.5–3.5%, | W: 1–3%, |
| V: 0.1–0.35%, | Nb: 0.01–0.1%, |
| B: 0.0001–0.02%, | N: less than 0.005%, |
| Al: less than 0.005%, | Ti: 0.001–0.1%, and |

a balance of Fe and incidental impurities.

5. The low-alloy steel of claim 1, which contains one or more elements selected from the group consisting of La, Ce, Y, Ca, Zr, and Ta: 0.01–0.2% each and Mg: 0.0005–0.05%.

6. The low-alloy steel of claim 1, which contains Mo: 0.01–0.4%.

7. The low-alloy steel of claim 1, which contains (a) one or more elements selected from the group consisting of La, Ce, Y, Ca, Zr, and Ta: 0.01–0.2% each and Mg: 0.0005–0.05%, and (b) Mo: 0.01–0.4%.

8. The low-alloy steel of claim 1, which consists essentially of:

| | |
|---|---|
| C: 0.05–0.08%, | Si: 0.01–0.4%, |
| Mn: 0.3–1%, | Ni: 0.01–0.4%, |
| P: at most 0.02%, | S: at most 0.005%, |
| Cr: 1.5–3.5%, | W: 1.4–1.8%, |
| V: 0.2–0.3%, | Nb: 0.03–0.08%, |
| B: 0.001–0.005%, | N: less than 0.005%, |
| Al: less than 0.005%, | Ti: 0.001–0.1%, |

one or more elements selected from the group consisting of: La, Ce, Y, Ca, Zr, and Ta: 0–0.15% each and Mg: 0–0.01%, Mo: 0–0.2%, and a balance of Fe and incidental impurities.

9. A low-alloy steel having improved creep strength and toughness, which consists essentially, on a weight basis, of:

| | |
|---|---|
| C: 0.03–0.12%, | Si: at most 0.7%, |
| Mn: 0.1–1.5%, | Ni: at most 0.8%, |
| P: at most 0.03%, | S: at most 0.015%, |
| Cr: 1.5–3.5%, | W: 1–3%, |
| V: 0.1–0.35%, | Nb: 0.01–0.1%, |
| B: 0.0001–0.02%, | N: less than 0.005%, |
| Al: less than 0.005%, | Ti: 0.001–0.1%, and |

a balance of Fe and incidental impurities, wherein the Ti and N contents satisfy the following inequality:

$$0.080 \geqq Ti(\%) - (48/14) \times N(\%) \geqq 0.003.$$

10. The low-alloy steel of claim 9, wherein the C content is 0.05–0.08%.

11. The low-alloy steel of claim 9, wherein the W content is 1.4–1.8%.

12. The low-alloy steel of claim 9, which contains

| | |
|---|---|
| C: 0.05–0.08%, | Si: 0.01–0.4%, |
| Mn: 0.3–1%, | Ni: 0.01–0.4%, |
| P: at most 0.02%, | S: at most 0.005%, |
| Cr: 1.5–3.5%, | W: 1.4–1.8%, |
| V: 0.2–0.3%, | Nb: 0.03–0.08%, |

-continued

| | |
|---|---|
| B: 0.001–0.005%, | N: less than 0.005%, |
| Al: less than 0.005%, and | Ti: 0.001–0.1%. |

13. A low-alloy steel having improved creep strength and toughness, which consists essentially, on a weight basis, of:

| | |
|---|---|
| C: 0.03–0.12%, | Si: at most 0.7%, |
| Mn: 0.1–1.5%, | Ni: at most 0.8%, |
| P: at most 0.03%, | S: at most 0.015%, |
| Cr: 1.5–3.5%, | W: 1–3%, |
| V: 0.1–0.35%, | Nb: 0.01–0.1%, |
| B: 0.0001–0.02%, | N: less than 0.005%, |
| Al: less than 0.005%, | Ti: 0.001–0.1%, |

one or more elements selected from the group consisting of La, Ce, Y, Ca, Zr, and Ta: 0.01–0.2% each, Mg: 0.0005–0.05%, and Mo: 0.01–0.4%, and a balance of Fe and incidental impurities, wherein the Ti and N contents satisfy the following inequality:

$$0.080 \geqq Ti(\%) - (48/14) \times N(\%) \geqq 0.003.$$

14. The low-alloy steel of claim 13, wherein the C content is 0.05–0.08%.

15. The low-alloy steel of claim 13, wherein the W content is 1.4–1.8%.

16. The low-alloy steel of claim 13, which contains

| | |
|---|---|
| C: 0.05–0.08%, | Si: 0.01–0.4%, |
| Mn: 0.3–1%, | Ni: 0.01–0.4%, |
| P: at most 0.02%, | S: at most 0.005%, |
| Cr: 1.5–3.5%, | W: 1.4–1.8%, |
| V: 0.2–0.3%, | Nb: 0.03–0.08%, |
| B: 0.001–0.005%, | N: less than 0.005%, |
| Al: less than 0.005%, and | Ti: 0.001–0.1%, |

one or more elements selected from the group consisting of La, Ce, Y, Ca, Zr, and Ta: 0.02–0.15% each, Mg: 0.0005–0.01%, and Mo: 0.05–0.2%.

17. The low-alloy steel of claim 1, having an elongation of at least 25% and a transition temperature in a Charpy Impact Test of no higher than −35° C.

18. The low-alloy steel of claim 9, having an elongation of at least 25% and a transition temperature in a Charpy Impact Test of no higher than −35° C.

19. The low-alloy steel of claim 13, having an elongation of at least 25% and a transition temperature in a Charpy Impact Test of no higher than −35° C.

* * * * *